US009644397B2

(12) United States Patent
Laabs et al.

(10) Patent No.: US 9,644,397 B2
(45) Date of Patent: May 9, 2017

(54) FOOD FREEZER LOCKS AND KEYS HAVING SAFETY FEATURES FOR PREVENTING CHILD ENTRAPMENT

(71) Applicants: Timothy P. Laabs, Palatine, IL (US); Michael O. Misner, Lake Villa, IL (US)

(72) Inventors: Timothy P. Laabs, Palatine, IL (US); Michael O. Misner, Lake Villa, IL (US)

(73) Assignee: THE EASTERN COMPANY, Wheeling, IL (US)

( * ) Notice: Subject to any disclaimer, the term of this patent is extended or adjusted under 35 U.S.C. 154(b) by 0 days.

(21) Appl. No.: 14/545,508

(22) Filed: May 14, 2015

(65) Prior Publication Data

US 2015/0330107 A1 Nov. 19, 2015

Related U.S. Application Data

(60) Provisional application No. 61/996,828, filed on May 16, 2014.

(51) Int. Cl.

| | |
|---|---|
| ***E05B 19/02*** | (2006.01) |
| ***E05B 27/00*** | (2006.01) |
| ***E05B 65/00*** | (2006.01) |
| ***E05B 27/08*** | (2006.01) |
| ***E05B 63/00*** | (2006.01) |

(Continued)

(52) U.S. Cl.

CPC ..... *E05B 27/0014* (2013.01); *E05B 15/0093* (2013.01); *E05B 19/0047* (2013.01); *E05B 27/0007* (2013.01); *E05B 27/0089* (2013.01); *E05B 27/08* (2013.01); *E05B 27/083* (2013.01); *E05B 63/003* (2013.01); *E05B 65/0042* (2013.01); *Y10T 29/49002* (2015.01);

(Continued)

(58) Field of Classification Search

CPC ..... E05B 19/00; E05B 19/04; E05B 19/0017; E05B 19/0035; E05B 19/0041; E05B 19/0047; E05B 19/22; E05B 19/24; E05B 27/00; E05B 27/0003; E05B 27/0007; E05B 27/0014; E05B 27/0085; E05B 27/0089; E05B 29/0073; E05B 29/008; E05B 63/003; E05B 65/0042

See application file for complete search history.

(56) References Cited

U.S. PATENT DOCUMENTS

| | | | | |
|---|---|---|---|---|
| 1,738,105 A | 12/1929 | Jacobi | ..... | 70/388 |
| 1,828,747 A | 10/1931 | Perry | ..... | 200/93.13 |

(Continued)

*Primary Examiner* — Christopher Boswell

(74) *Attorney, Agent, or Firm* — David A. Burge

(57) ABSTRACT

A tubular lock and its operating key have safety features that render the lock and key well suited for use with food freezer appliances and the like where the keyway of the lock extends horizontally. The tubular portion of the operating key, and the keyway of the tubular lock are cooperatively configured so a key inserted into the keyway of the lock fits quite loosely and is minimally supported even when fully inserted. The graspable bow of the operating key is made unusually long causing the center of gravity of an inserted operating key to be spaced far from the front face of the lock—so the weight of the loosely fitting and minimally supported operating key levers the graspable bow downwardly, causing the key to drop from the keyway unless being held in the keyway. Gravity is optimally used to effect key ejection.

22 Claims, 9 Drawing Sheets

(51) Int. Cl.
*E05B 15/00* (2006.01)
*E05B 19/00* (2006.01)

(52) U.S. Cl.
CPC ..... *Y10T 29/49828* (2015.01); *Y10T 70/7486* (2015.04); *Y10T 70/7791* (2015.04)

(56) References Cited

U.S. PATENT DOCUMENTS 1,946,722 A 2/1939 Thompson ..... 70/388
3,093,920 A * 6/1963 Epstein ..... E05B 19/04 40/330
3,360,619 A 12/1967 Grocott et al. ..... 200/44
3,484,569 A 12/1969 Euston ..... 200/44
3,492,843 A 2/1970 Schieber ..... 70/388
3,524,335 A * 8/1970 George ..... E05B 27/083 70/388
3,552,160 A 1/1971 Kleebauer ..... 70/388
3,648,492 A 3/1972 Walters et al. ..... 70/363
3,661,000 A 5/1972 Kerr ..... 70/388
3,661,001 A 5/1972 Glass ..... 70/388
3,744,286 A * 7/1973 Trainor ..... E05B 19/00 70/404
3,748,881 A 7/1973 Erickson ..... 70/388
3,793,497 A 2/1974 Di Gaetano ..... 200/44
3,826,116 A 7/1974 Messera et al. ..... 70/388
3,971,242 A 7/1976 Mikos ..... 70/388
3,995,463 A 12/1976 Mikos ..... 70/388
4,022,039 A 5/1977 Mikos ..... 70/388
4,106,317 A 8/1978 Anderson ..... 70/388
4,878,367 A * 11/1989 Bisbing ..... E05B 35/008 70/404
5,024,072 A * 6/1991 Lee ..... E05B 19/04 70/404
5,024,073 A * 6/1991 Lloyd ..... E05C 5/04 70/208
5,819,569 A * 10/1998 Herdman ..... E05B 27/005 70/383
6,957,556 B1 * 10/2005 Ha ..... E05B 19/00 70/403
6,969,810 B1 11/2005 Davidsz ..... 200/61.66
8,763,435 B2 * 7/2014 McCaffrey ..... E05B 19/0017 70/392

* cited by examiner

PRIOR ART

FOOD FREEZER LOCKS AND KEYS HAVING SAFETY FEATURES FOR PREVENTING CHILD ENTRAPMENT

REFERENCE TO PROVISIONAL APPLICATION

The present application claims the benefit of the filing date of Provisional Application Ser. No. 61/996,828 filed May 16, 2014 by Timothy P. Laabs and Michael O. Misner entitled Food Freezer Locks and Keys, the disclosure of which is incorporated herein by reference.

FIELD OF THE INVENTION

The present invention relates to an economical and reliable approach that is used to significantly enhance the safety of food freezer appliances and certain other lockable enclosures that often are found to present a danger of child entrapment—by preventing the operating keys of such lockable enclosures from being retained in the keyways of the locks when the keys are not being held in the keyways of the locks.

When operating keys are inadvertently retained in the keyways of food freezer locks between times of use of the keys to operate the locks, the presence of the keys can present an attractive nuisance that invites mischievous use of the keys by children who have been known to view the lockable enclosures of food freezers as space capsules, jail cells, play houses and the like. Keeping the keys to food freezer locks (and to the locks of similar lockable enclosures) out of the hands of children has become widely recognized as a desirable safeguard.

As will be explained, the approach utilized by the present invention calls for the operating keys and the keyways of tubular locks to be cooperatively configured so optimal use can be made of the force of gravity to cause the operating keys to drop from the keyways of the tubular locks unless the keys are being held in the keyways of the locks. The influence of the force of gravity is used in an optimal way to effect key ejection.

Tubular Locks and Tubular Cam Locks

A so-called "tubular lock" usually has a housing with a passage extending centrally therethrough that journals a plug that can be turned about a central axis of the passage relative to the housing.

A tubular lock that has a radially extending cam fixed to the rear of the plug is called a "tubular cam lock." When the lock permits the plug to turn relative to the housing, the cam turns concurrently with the plug.

Food freezer appliances are commonly provided with tubular locks, most of which also qualify as "tubular cam locks."

Incorporation Herein of Disclosures of Issued Patents

To aid the reader in understanding how tubular cam locks of the general types shown in FIGS. 2-7 are typically mounted in holes formed through metal panels, and how the rear-mounted cams of such cam locks are pivoted a quarter turn by such tubular operating keys as are shown in FIGS. 8-11 between locked and unlocked orientations, reference is made to U.S. Pat. No. 3,648,492 issued Mar. 14, 1972 to Russell W. Walters et al (see especially FIGS. 1 and 2 thereof), the disclosure of which is incorporated herein by reference. The Walters et al patent also discloses a typical PRIOR ART locking mechanism used by tubular locks.

To aid the reader in understanding how a typical PRIOR ART cam lock is incorporated into a typical food freezer appliance to selectively permit and prevent opening of the food freezer's closure, reference is made to U.S. Pat. No. 4,106,317 issued Aug. 15, 1978 to Bruce Anderson (see especially FIG. 1 thereof), the disclosure of which is incorporated herein by reference.

BACKGROUND

Tubular locks are widely used to secure the lockable enclosures of food freezer appliances. The keyways of tubular locks, and the keys used to operate tubular locks, are commonly configured so the keys are snugly received in the keyways of the locks, and so the keys are retained once they have been inserted into the keyways. If children find operating keys that have been left in the keyways of food freezer locks, the children are sometimes tempted to use the keys to operate the food freezer locks, and to turn the lockable enclosures of food freezer appliances into playthings.

It is customary to take precautions to ensure that children do not easily gain access either to the keys that operate the locks of food freezer appliances, or to the keys of locks that control access to other types of lockable enclosures where children are likely to suffer harm they should become entrapped therein.

One precaution in wide use is to provide legibly printed warnings on the graspable bows of the keys to the locks of food freezers—warnings urging that the keys not be left in the keyways of the food freezer locks, and that the keys be kept at locations removed from the food freezer appliances. A typical warning in wide use is:

Caution: To Help Prevent Child Entrapment Keep Key Out of Reach of Children and Away from Food Freezer Proposals have been made from time to time for providing the locks of food freezer appliances and other lockable enclosures with a variety of mechanical contrivances for ejecting operating keys unless the keys are being used to operate the locks. Few if any of these proposals have achieved much acceptance due in large part to their complexity, their cost, and often due to their failure to achieve reliability during lengthy service lives.

The Problem of Food Freezer Keys being Left in Keyways

Some people who leave the keys to food freezer locks in the keyways of the locks do so inadvertently. This can easily happen inadvertently for two at least two reasons.

First, the vast majority of food freezer locks in use today are of the tubular type—and, the tubular keys are almost always sized and configured to provide a reasonably snug fit when inserted into the tubular keyways of the locks. The keys are not designed to fall from the keyways once inserted—but rather are intended to be retained in the keyways so inserted keys can be used quickly and easily. No designer of a food freezer lock has wanted the key that operates the lock to drop from the keyway, or to be difficult to use.

Second, the tubular keys and the tubular keyways of the locks are almost always provided with interfitting components, formations or parts that cooperatively engage. Most tubular keys have a radially outwardly extending formation—a small projection or lug—that must be inserted through a slot, cut or recess provided by the lock adjacent the keyway of the lock—and, these interfitting formations not only require that a tubular key be very specifically turned to a particular orientation in order to be inserted, but also provide a means of positively retaining the key in the keyway once the key has been fully inserted and turned even slightly so that the small projection or lug is caused to reside behind a curved, radially inwardly extending formation provided by the lock adjacent the tubular keyway of the lock. Sometimes it is simply more convenient for the key to be left in the keyway than it is to fuss with turning the key to the exact orientation required to effect withdrawal of the key from the keyway.

Some people deliberately leave the keys to food freezer locks in the keyways of the locks. They like the convenience of being able to use the already-in-place key like a doorknob—to open the food freezer easily whenever desired. They do not like having to chase about to find the key to a food freezer lock wherever the key may have been placed or secreted the last time the freezer was opened and locked.

A problem that commonly arises (if the tubular key to a food freezer lock is left in the tubular keyway of the lock) is that the key probably has already been used to operate the lock—which means that the key has already correctly rearwardly moved the tumbler pins of the lock the exact distances needed to unlock the lock—hence the tumbler pins are already correctly depressed to make it quite easy to unlock the freezer once the key has already been turned in the keyway of the lock—so, it quite often is the case that a key left in a food freezer lock simply needs to be turned slightly to the "unlocked" orientation in order for the lockable closure of the food freezer to be opened. No thoughtful manipulation of a left-in-place food freezer key likely is needed to open the sizable enclosure of a food freezer, other than to turn the key less than a quarter-turn to an "unlocked" orientation, and suddenly the closure of the food freezer may nicely "pop open." This is often how the dreadful problem of child entrapment begins.

Few persons who leave the keys to food freezer locks in the keyways of the locks realize or appreciate that a left-in-place food freezer key is quite like a loaded and cocked gun that needs only minuscule movement of its trigger for a life-threatening problem to begin.

What the present invention seeks to prevent is not only the problems that arise because the keys to food freezer locks are either inadvertently or deliberately left in the keyways of food freezer locks, but also such problems as can arise if children or others find a correctly configured food freezer key that has not been left in the keyway of a food freezer lock. A feature of the present invention can make it at least somewhat difficult for even a correctly configured tubular key to be used to successfully operate a tubular food freezer lock unless the person in possession of the key understands how the key needs to be oriented during keyway insertion.

SUMMARY

The present invention takes quite a different approach than has been used previously in addressing the problem of preventing operating keys from being left inadvertently in, or retained in, horizontally-extending keyways of food freezer locks and the like.

No previous effort has been made to dimensionally and structurally modify the configurations of food freezer keys and locks so the force of gravity ensures that operating keys are not retained in the keyways of the tubular locks of food freezers between times of use of the tubular keys to operate the locks.

In some embodiments of the invention, at least one of the following three types of improvements are made to enhance the likelihood that the force of gravity will cause the tubular operating keys of tubular food freezer locks to drop from the keyways of the locks unless the keys are being held in the keyways. In preferred practice, all three of the following types of improvements are made to optimize how the influence of the force of gravity is used to cause the tubular operating keys of food freezer locks to drop from the tubular keyways of the locks unless the keys are being held in the keyways of the locks:

1) Looseness of Fit:

One reason that the operating keys of food freezer locks are commonly retained after being inserted into the keyways of the locks is because the keys fit snugly when inserted into the keyways which are relatively long. The present invention radically changes this common practice by cooperatively configuring operating keys and the keyways of food freezer locks so the keyways are shorter and quite loosely receive inserted operating keys so the keys must, in fact, be held in the keyways if the keys are to remain in the keyways. Dimensions and configurations of present-day tubular locks and their tubular operating keys that cause operating keys to fit snugly when inserted into the keyways of the locks are quite significantly changed—to cause inserted operating keys to fit much more loosely in the keyways of the locks;

2) Elimination of Support:

Another reason that the operating keys of food freezer locks are commonly retained after being inserted into the keyways of the locks is because the keys and the locks have formations that interengage once the keys have been inserted into the keyways and turned a tiny amount; and, the interengaging formations positively retain the keys unless and until the keys are turned to one or more quite specific orientations that permit disengagement of the interengaging formations. The present invention calls for the interengaging formations of present-day tubular locks to be eliminated—so that such interengaging formations of the keys and keyways that have cooperatively provided support to keyway-inserted operating keys (and that have also positively prevented inserted operating keys from being withdrawn from the keyways unless and until the keys are turned to a specific orientation), are eliminated—which means that inserted keys 1) are not retained in the keyways by interengaging formations, 2) are not supported due to the interaction of interengaging formations, and 3) can move out of the keyways at every orientation, regardless of how the inserted keys may be oriented or turned in the keyways;

3) Heavier, Longer Keys:

Still another reason why present-day tubular operating keys tend to be retained in present-day tubular locks of the kind used commonly on food freezer appliances is that the operating keys themselves are relatively short and of relatively lightweight construction, and have centers of gravity that are located relatively short distances from the front faces of the tubular locks at times when the operating keys are inserted into the keyways of the locks. The key-retaining effects of the relatively snug fit, and the presence of interfitting formations (as discussed above) are not overcome by the force of gravity acting on the relatively lightweight operating keys. A preferred practice of the present invention calls for slightly more metal to preferably be used in operating key fabrication—so the operating keys are made heavier by at least causing the graspable bows of the keys to be made longer—to change operating keys from having graspable bows that are about the size of a nickel or quarter coin to about the size of two to three quarter coins laid side-by-side; and, the keyways themselves are made slightly shorter than has been common practice—all of which shifts the center of gravity of keyway-inserted keys away from the front face of food freezer locks, and causes the weight of the heavier and longer operating keys to act through longer lever arms to downwardly tilt the graspable bows and to begin withdrawal of the more loosely fitting and poorly supported operating keys down and out of the keyways of food freezer locks.

A significant advantage of the invention is that little if any production cost increase whatsoever is incurred 1) by modifying the keys and keyways of tubular food freezer locks to loosen the "fit" of the keys within the keyways of the locks, 2) by eliminating interfitting formations of the keys and keyways, 3) by diminishing the support provided to the keys by the keyways of the locks, or 4) by lengthening the graspable bows of the operating keys while adding a few grams of weight to the graspable bows of the operating keys.

Indeed, the novel approach taken by the present invention toward preventing operating keys from being retained in the keyways of tubular food freezer locks is one of the least costly set of modifications that can be adopted by the manufacturers of food freezer locks and keys to measurably enhance the safety of food freezer appliances.

The Bailiwick of this Invention

Residing at the heart of the present invention is a desire to make optimal use the force of gravity to cause enhanced operating keys to self-eject from the keyway of enhanced locks when the keys are not being held in the keyways or used to operate the locks—so that operating keys are not, and, indeed, cannot, be left in the keyways of locks where the keys may discovered and perhaps used inappropriately or even in dangerous ways by children or others.

Although those who are skilled in the art will readily appreciate that some aspects of the approach used by the present invention can be used with locks of a variety of types, a primary focus of the invention is on tubular locks that are installed so the tubular keyways of the locks extend substantially horizontally—which is how tubular locks are commonly installed on food freezer appliances where the lockable enclosures have been found to present an unusually high risk of child entrapment.

As will be explained later in this document, a secondary focus of the invention resides in making it somewhat difficult even for a person who is in possession of a correctly configured enhanced operating key to properly insert the enhanced operating key into the keyway of an enhanced lock so the inserted enhanced operating key can be used to lock or to unlock the enhanced lock. By making it at least somewhat difficult for the enhanced lock to be operated even by a person who is in possession of a correctly configured enhanced operating key, a further step is taken to prevent children from becoming entrapped within the lockable enclosure of a food freezer appliance on which the enhanced tubular lock is installed.

As will be explained, an approach that preferably is taken, is to require that the enhanced operating key be turned to a particular insertion orientation in order to be used to operate the lock, with neither the enhanced operating key nor the enhanced lock specifically disclosing the nature of the required insertion orientation.

As will be readily be appreciated and understood by those who are skilled in the art, the lock and key design approaches used by the present invention fly in the face of the mantra consistently followed by the designers of tubular locks who have always tried to make it easy rather than difficult for correctly configured operating keys to be used to unlock food freezer locks, who have commonly sought to provide tubular locks with keyways that snugly receive and provide good support to inserted operating keys, who have consistently provided tubular locks and their operating keys with interfitting formations that retain and securely support inserted operating keys once inserted keys have been turned ever so slightly from one of the specific orientations that permit insertion—and, who have sought to provide operating keys of minimal size and weight that leave no question as to how the operating keys should be inserted in order to quickly effect lock operation.

BRIEF DESCRIPTION OF THE DRAWINGS

Features and advantages of the present invention are more fully disclosed in the description and claims that follow, and will be better understood by referring to the accompanying drawings, wherein:

FIG. 15 is a front elevational view of a preferred embodiment of the enhanced tubular lock showing a tiny notch that opens into the keyway to provide nothing more than an orientation indicator to those who install the enhanced tubular lock on a closure or the like;

DEFINITIONS

Figure 1:
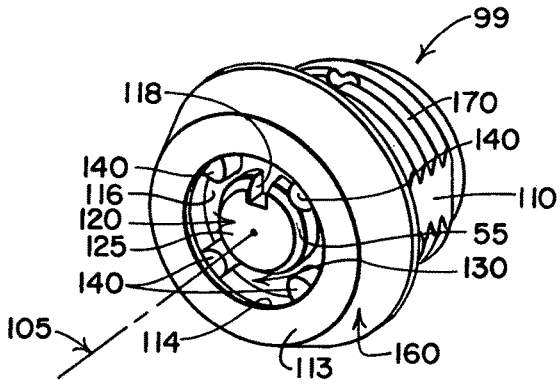
FIG. 1 is a perspective view showing an enhanced tubular lock sub-assembly that embodies features of the present invention.
Figure 3:
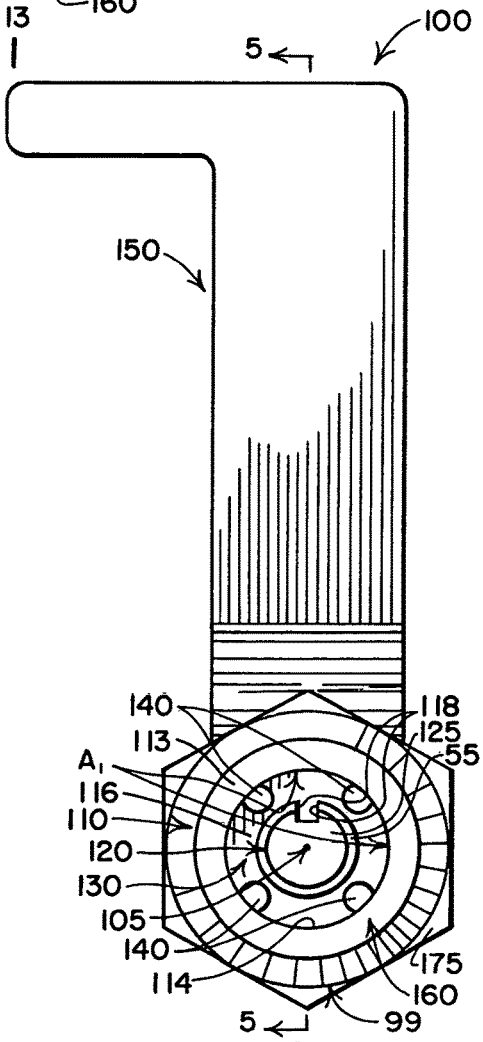
FIG. 3 PRIOR ART
FIG. 3 is a front elevational view of an enhanced tubular cam lock that includes the sub-assembly of FIG. 1 together with a mounting nut and hook-shaped cam.
Figure 2:
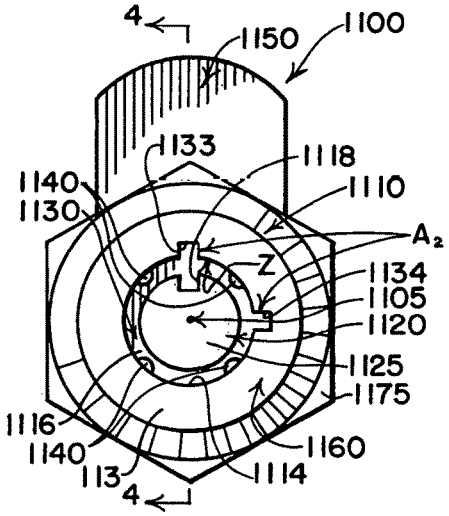
FIG. 2 is a front elevational view of a popular form of commercially available PRIOR ART tubular cam lock used on present-day food freezer appliances.
Figure 4:
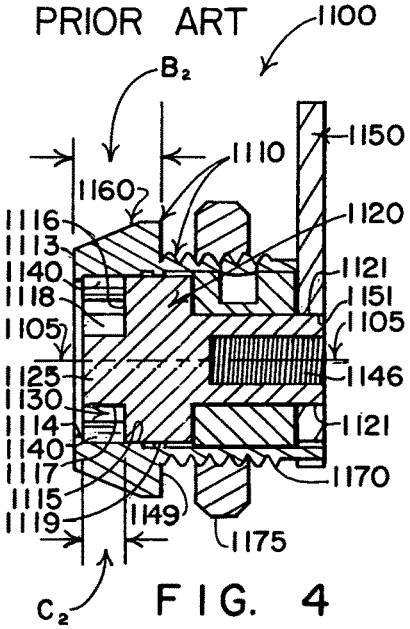
FIG. 4 is a somewhat schematic cross-sectional view of the PRIOR ART tubular cam lock shown in FIG. 2, as seen from a plane indicated by a line 4-4 in FIG. 2, with the view having omitted therefrom a threaded fastener that retains a depicted rear-mounted cam thereon.
Figure 5:
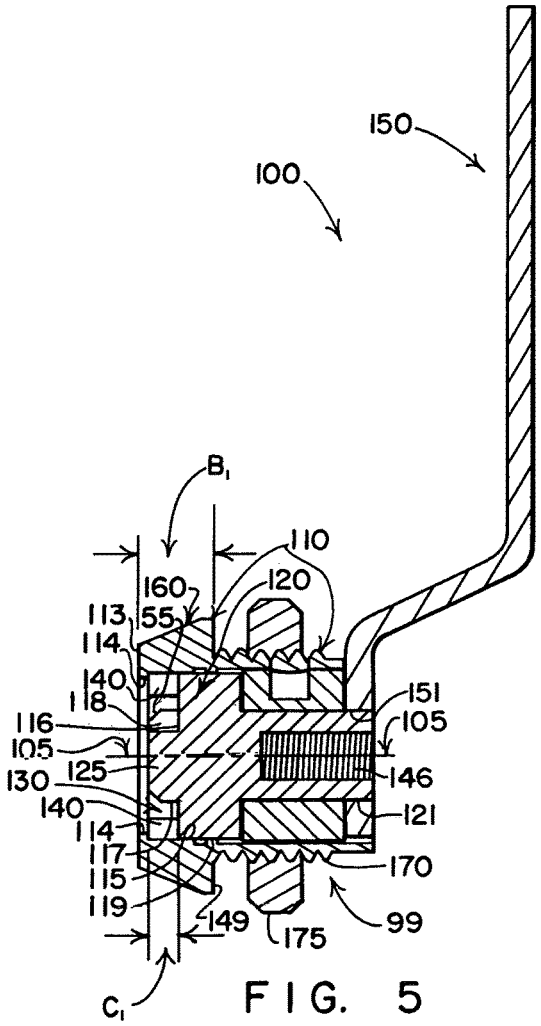
FIG. 5 is a somewhat schematic cross-sectional view of the enhanced tubular cam lock of FIG. 3, as seen from a plane indicated by a line 5-5 in FIG. 3, with the view having omitted therefrom the threaded fastener that retains the depicted rear-mounted cam.
Figure 8:
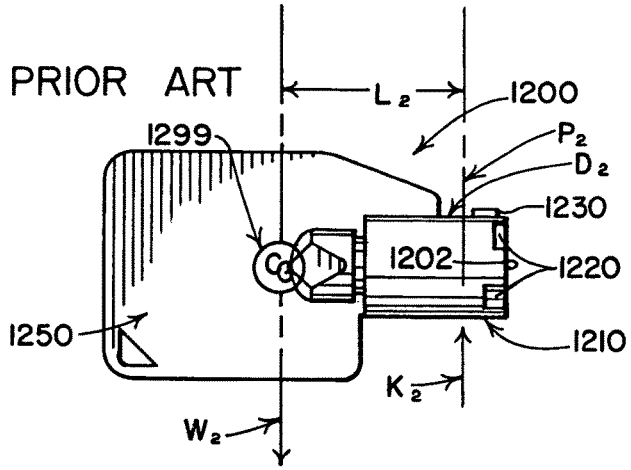
FIG. 8 is a side elevational view of a PRIOR ART tubular operating key such as is commonly used to operate the PRIOR ART tubular cam lock of FIGS. 2, 4 and 6, with the key having a short tubular component, and a nearly equally short graspable bow that has about the size of a nickel coin to about the size of a quarter coin.
Figure 9:
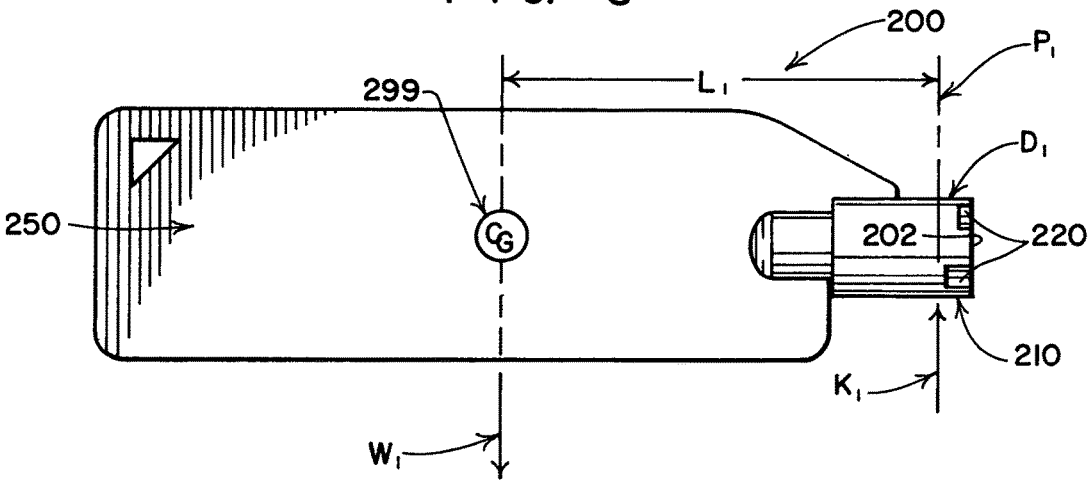
FIG. 9 is a side elevational view of an enhanced tubular operating key for operating the enhanced tubular cam lock sub-assembly such as is shown in FIG. 1, and for operating the enhanced tubular cam lock shown in FIGS. 3, 5 and 7, with the key having a short tubular component, and a much longer graspable bow that has about the size of two to three quarter coins laid side-by-side.
Figure 10:
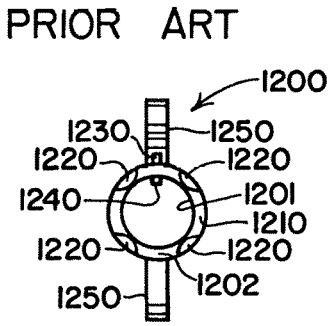
FIG. 10 is a right end view of the PRIOR ART operating key of FIG. 8, with it being seen that the graspable bow has a thickness of about that of a penny coin.
Figure 11:
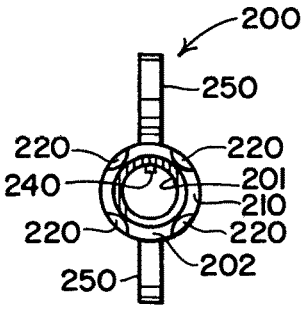
FIG. 11 is a right end view of the enhanced operating key of FIG. 9, with it being seen that the graspable bow has a thickness of about that of a nickel coin to about that of a quarter coin.
Figure 12:
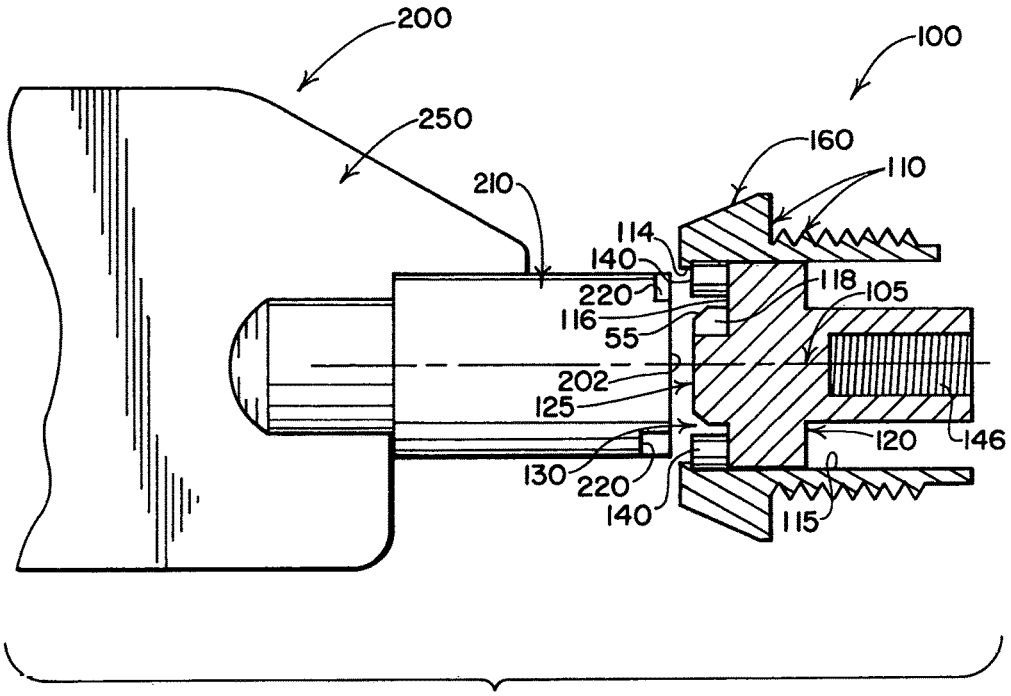
FIG. 12 is a schematic depiction of selected portions of the enhanced tubular operating key positioned to enter the keyway of the enhanced tubular lock, it being noted that the operating key has recesses that are configured to receive, engage and rearwardly depress a set of forwardly-biased (i.e., biased leftwardly, as viewed in FIG. 12) tumbler pins of the lock as the enhanced operating key is moved rearwardly (i.e., moved rightwardly as viewed in FIG. 12) during insertion of the enhanced operating key into the keyway of the enhanced tubular lock.
Figure 13:
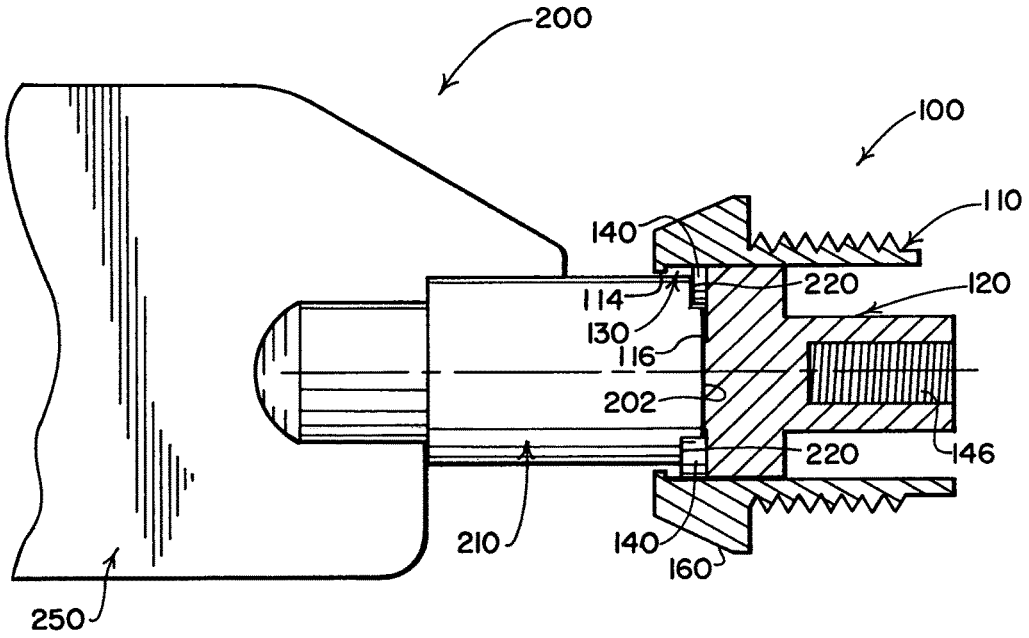
FIG. 13 is a schematic depiction of the selected lock and key portions shown in FIG. 12, with the enhanced tubular operating key shown fully inserted into the keyway of the enhanced tubular lock, with forwardly-biased tumbler pins of the lock being received in the recesses of the key and being rearwardly depressed by insertion of the key to the fully inserted position.

The term "tubular lock" (as used herein) refers to a lock having a tubular keyway of the general type indicated by the numeral 130 in FIGS. 1, 3 and 5 AND that is operated by a key having a tubular component such as is indicated by the numeral 210 in FIGS. 9 and 11; or to a lock that has a tubular keyway of the general type indicated by the numeral 1130 in FIGS. 2 and 4 AND that is operated by a key having a tubular component such as is indicated by the numeral 1210 in FIGS. 8 and 10.

The term "tubular key" (as used herein) refers to a key that has a tubular component of the general type indicated by the numeral 210 in FIGS. 9 and 11 AND that is insertable into a tubular keyway such as is indicated by the numeral 130 in FIGS. 1, 3 and 5 to operate a tubular lock such as is indicated by the numeral 99 in FIG. 1 or by the numeral 100 in FIGS. 3 and 5; or to a key that has a tubular component of the general type indicated by the numeral 1210 in FIGS. 8 and 10 AND that is insertable into a tubular keyway such as is indicated by the numeral 1130 in FIGS. 2 and 4 to operate a tubular lock such as is indicated by the numeral 1100 in FIGS. 2 and 4.

The term "tubular keyway" (as used herein) refers to a keyway of the general type indicated by the numeral 130 in FIGS. 1, 3, and 5 AND that can receive a tubular key component such as is indicated by the numeral 210 in FIGS. 9 and 11 to operate a tubular lock such as is indicated by the numeral 99 in FIG. 1 or by the numeral 100 in FIGS. 3 and 5; or to a keyway of the general type indicated by the numeral 1130 in FIGS. 2 and 4 AND that can receive a tubular key component such as is indicated by the numeral 1210 in FIGS. 8 and 10 to operate a tubular lock such as is indicated by the numeral 1100 in FIGS. 2 and 4.

The term "typical present-day tubular lock" (as used herein) refers to a tubular lock that has the general appearance of the PRIOR ART tubular lock 1100 shown in FIGS. 2 and 4, that has a horizontally extending tubular keyway of the general type indicated by the numeral 1130 in FIGS. 2 and 4, AND that is operated by a PRIOR ART operating key having a tubular component of the general type indicated by the numeral 1210 shown in FIGS. 8 and 10, with the tubular component of the operating key and the keyway being cooperatively configured so the tubular component of an inserted operating key is reasonably snugly received in the keyway and is retained therein unless and until manually withdrawn.

The term "typical present-day tubular key" (as used herein) refers to a tubular key that has the general appearance of the PRIOR ART tubular key 1200 shown in FIGS. 8 and 10, with a tubular component of the general type indicated by the numeral 1210 in FIGS. 8 and 10, with the key having a relatively short graspable bow of about the size of a nickel coin to about the size of a quarter coin, with the tubular component being reasonably snugly received when inserted into the keyway, and being retained therein unless and until manually withdrawn.

The term "typical present-day tubular keyway" (as used herein) refers to a tubular keyway of the general type indicated by the numeral 1130 in FIGS. 2 and 4 that opens through the front face of a tubular lock of the general type indicated by the numeral 1100 in FIGS. 2 and 4, with the keyway being configured to reasonably snugly receive and to retain therein the inserted tubular component of a PRIOR ART operating key of the general type indicated by the numeral 1200 in FIGS. 8 and 10 unless and until manually withdrawn.

The term "enhanced tubular lock" (as used herein) refers to a tubular lock having a horizontally extending tubular keyway of the general type indicated by the numeral 130 in FIGS. 1, 3 and 5 that is operated by an enhanced operating key of the general type indicated by the numeral 200 in FIGS. 9 and 11, with the inserted operating key having a tubular component that is received quite loosely within, and is minimally supported by, the keyway so as to drop under the influence of the force of gravity from the keyway unless being held in the keyway.

The term "enhanced tubular key" (as used herein) refers to a tubular key having the general appearance of the tubular key 200 shown in FIGS. 9 and 11, with the key having no radially extending projection or lug of the type indicated by the numeral 1230 in FIGS. 8 and 10, and preferably having an unusually long graspable bow of about the size of two to three quarter coins placed side by side, with the graspable bow (in some embodiments such as is shown in FIG. 11) also preferably being slightly thicker and taller than the bow 1250 of the PRIOR ART tubular key 1200 shown in FIG. 10, and with the tubular component of an inserted operating key fitting loosely and being so minimally supported as to drop from the keyway under the influence of the force of gravity unless being manually held in the keyway.

The term "enhanced tubular keyway" (as used herein) refers to tubular keyway of the general type indicated by the numeral 130 in FIGS. 1, 3 and 5, with the keyway and a tubular component of a keyway-inserted operating key being cooperatively configured so the tubular component is quite loosely received in, and is minimally supported by the keyway so the key will drop from the keyway under the influence of the force of gravity unless being manually held in the keyway.

The Use Herein of Corresponding Numerals

In this document, what are referred to as "corresponding numerals" are used that differ by a magnitude of 1000 to refer to corresponding features or components of the enhanced cam lock 100 and the PRIOR ART cam lock 1100.

Likewise "corresponding numerals" that differ by a magnitude of 1000 also are used herein to refer to features or components of the enhanced operating key 200 and the PRIOR ART operating key 1200.

The use of such corresponding numerals eliminates the need to repeat many of the descriptions that pertain to the enhanced cam lock 100 vs. the PRIOR ART cam lock 1100, and that pertain to the enhanced operating key 200 vs. the PRIOR ART operating key 1200.

The Horizontally Extending Central Axes 105, 1105

Many of the components of the tubular locks 100, 1100 extend concentrically about, and may also turn relative to each other about forwardly-rearwardly extending central axes 105, 1105 of the locks 100, 1110, respectively. When the tubular locks 100, 1100 are installed in a conventional manner on food freezers, the central axes 105, 1105 extend substantially horizontally.

Proper operation of the enhanced tubular lock 100 of the present invention is dependent to a significant extent on the central axis 105 of the installed lock 100 being oriented to extend horizontally because the influence of the force of gravity (which acts vertically) needs to act perpendicularly to the orientation of the central axis 105 in causing the enhanced operating key 200 to drop from the keyway 130 unless the enhanced operating key 200 is being used to operate the enhanced lock 100.

DETAILED DESCRIPTION

An improved, enhanced, tubular cam lock sub-assembly embodying features of the present invention is indicated generally by the numeral 99 in FIG. 1. An assembled cam lock 100 that includes not only the sub-assembly 99, but also a hex mounting nut 175 and a rear-mounted cam 150, is shown in FIGS. 3, 5 and 7.

Adjacent Drawing Views Facilitate Comparison

Figure 6:
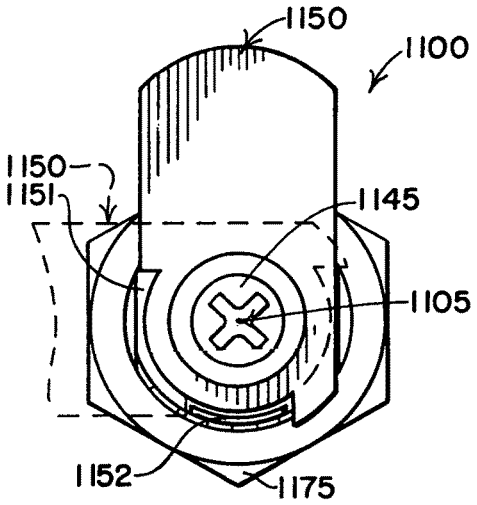
FIG. 6 is a rear elevational view of the PRIOR ART tubular cam lock shown in FIGS. 2 and 4, with the view showing only a head portion of a threaded fastener that retains the depicted rear-mounted cam, with the view using solid lines to show the rear-mounted cam in one of two locked and unlocked orientations, and with the view using broken lines to show a portion of the rear-mounted cam in the other of the two locked and unlocked orientations that each can be reached by a quarter turn movement of an appropriately configured PRIOR ART operating key (such as is shown in FIG. 8) inserted into the keyway of the depicted PRIOR ART tubular cam lock.
Figure 7:
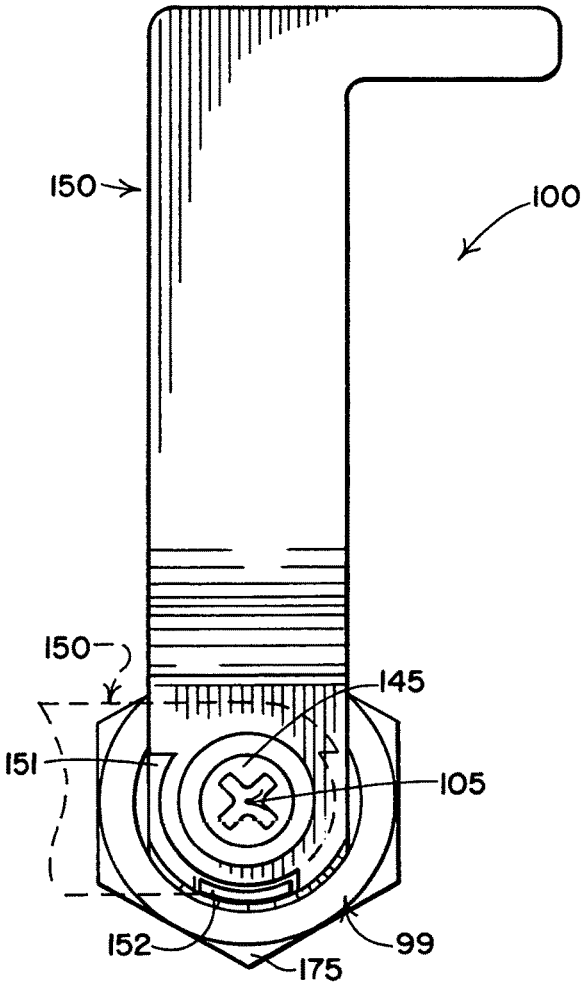
FIG. 7 is a rear elevational view of the enhanced tubular cam lock of FIGS. 3 and 5, with the view showing only a head portion of a threaded fastener that retains the depicted rear-mounted cam thereon, with the view utilizing solid lines to show the rear-mounted cam in one of two locked and unlocked orientations, and using broken lines to show a portion of the rear-mounted cam in the other of the two possible locked and unlocked orientations that each can be reached by a quarter turn movement of an appropriately configured operating key (such as is shown in FIGS. 9 and 11) inserted into the keyway of the depicted enhanced tubular cam lock.

To aid the reader in easily grasping the somewhat subtle but significant differences that exist between an enhanced tubular cam lock 100 and a typical PRIOR ART tubular cam lock 1100 of a type that currently is in wide use on food freezers, the accompanying drawings include a series of adjacent views of the tubular cam locks 1100 and 100 as follows:

| VIEWS SHOWING THE PRIOR ART LOCK 1100 | VIEWS SHOWING THE ENHANCED LOCK 100 |
|---|---|
| FIG. 2 Front View | FIG. 3 Front View |
| FIG. 4 Cross-Sectional View | FIG. 5 Cross-Sectional View |
| FIG. 6 Rear View | FIG. 7 Rear View |

To aid the reader in easily grasping the somewhat subtle but significant differences that exist between an enhanced tubular operating key 200 and a PRIOR ART tubular operating key 1200 used to operate the locks 100 and 1000, respectively, the accompanying drawings include adjacent views of the keys 1200 and 200 as follows:

| VIEWS SHOWING THE PRIOR ART OPERATING KEY 1200 | VIEWS SHOWING THE ENHANCED OPERATING KEY 200 |
|---|---|
| FIG. 8 Side View | FIG. 9 Side View |
| FIG. 10 End View | FIG. 11 End View |

Features of the Tubular Locks & the Tubular Operating Keys

Although the PRIOR ART tubular cam lock 1100 shown in FIGS. 2+4+6, and the enhanced tubular cam lock 100 shown in FIGS. 3+5+7 have many features that are similar, distinctions are explained in the description that follows. Likewise, although the PRIOR ART operating key 1200 shown in FIGS. 8+10 has many features that are similar to those of the enhanced operating key shown in FIGS. 9+11, distinctions are explained in the description that follows.

The tubular cam locks 100, 1100 have similarly configured housings 110, 1110 that define similarly configured passages 115, 1115 that extend through the housings 110, 1110 and are concentric about central axes 105, 1105, respectively. Similarly configured plugs 120, 1120 are journaled within the passages 115, 1115, and can turn about the axes 105, 1105, respectively, when locking mechanisms (not shown) of the locks 100, 1100 permit such relative turning movement of the plugs 120, 1120 and the housings 110, 1110, respectively.

The present invention has nothing to do with the particular type of locking mechanism that may be used by a tubular lock embodying features of the present invention. Inasmuch as the PRIOR ART is replete with disclosures of tubular lock locking mechanisms, many details of a typical locking mechanism that can be used with features of the present invention are not presented in this document—however, a typical PRIOR ART locking mechanism used by tubular locks is disclosed in the Walters et al patent that is referenced previously, the disclosure of which is incorporated herein by reference. The locking mechanism of the Walters et al patent has forwardly-biased tumbler pins such as those that are indicated by the numerals 140, 1140 in FIGS. 1+3+5 and 2+4, respectively, that are engaged and moved rearwardly (by recesses 220, 1220 of an operating key such as is depicted in FIGS. 8+9+10+11 hereof) during keyway insertion of such an operating key.

As is best shown in FIGS. 4 and 5, each of the plugs 120, 1120 is a one-piece item. The plugs 120, 1120 have relatively large diameter rear portions 119, 1119, and relatively small diameter front portions 125, 1125—and, flat, annular, forwardly-facing shoulders 116, 1116 extend between and connect the plug diameters 119/125 and 1119/1125, respectively. The small diameter front portions 125, 1125 of the plugs 120, 1120 are referred to as the centerpins 125, 1125 of the plugs 120, 1120—or, as the centerpins of the locks 100, 1100, respectively.

A first of the many somewhat subtle distinctions that preferably differentiate the enhanced lock 100 from the PRIOR ART lock 1100 has to do with differences in the centerpins 125, 1125. Whereas the centerpin 125 of the enhanced tubular lock 100 has a forward end region that is provided with a very noticeable chamfer 55 that can be seen in FIGS. 1+3+5, the forward end region of the centerpin 1125 of the PRIOR ART tubular lock 1100 (as shown in FIGS. 2+4) has no noticeable corresponding chamfer.

The presence of the chamfer 55 is one reason why the maximum outer diameter of the centerpin 125 of the enhanced tubular lock 100 is shorter than is the maximum diameter of the centerpin 1125 of the PRIOR ART tubular lock 1100. The longer length of the maximum diameter of the centerpin 1125 of the PRIOR ART lock 1100 means that, when the centerpin 1125 extends into the interior 1201 (FIG. 10) of the PRIOR ART operating key 1200, the centerpin 1125 of the PRIOR ART lock 1100 provides more robust support to the PRIOR ART operating key 1200 than the shorter maximum diameter portion of the chamfered centerpin 125 of the enhanced lock 100 provides to the enhanced operating key 200.

The chamfer 55 is preferably a 45 degree chamfer that extends from the maximum external diameter of the centerpin 125 to a circular center portion of the flat front surface of the centerpin 125 that is typically only about 75 percent of the maximum diameter of the centerpin 125—hence, the chamfer 55 is quite noticeable and is dimensionally significant.

Moreover, as can be seen by comparing the short centerpin length dimension $C_1$ shown in FIG. 5 with the longer corresponding centerpin length dimension $C_2$ shown in FIG. 4, the centerpin 125 of the enhanced lock 100 is even notably shorter than is the centerpin 1125 of the PRIOR ART lock 1100. By this arrangement, the centerpin 125 of the enhanced lock 100 provides even less internal support to the enhanced operating key 200 (when the enhanced operating key 200 is fully inserted into the keyway 130 of the enhanced lock 100) than the centerpin 1125 of the PRIOR ART lock provides to the PRIOR ART operating key 1200 (when fully inserted into the keyway 1130 of the PRIOR ART lock 1100).

The centerpin 125 of the enhanced tubular lock 100 not only is chamfered and shorter (in comparison with the non-chamfered and longer centerpin 1125 of the PRIOR ART tubular lock 1100), but preferably also fits much more loosely within the interior 201 (FIG. 11) of the enhanced operating key 200 than does the much more snugly fitting centerpin 1125 of the PRIOR ART lock 1100 when inserted into the interior 1201 (FIG. 10) of the PRIOR ART operating key 1200. This added looseness of fit can be created by diminishing the external diameter of the centerpin 125 of the lock 100 relative to the internal diameter of the interior of the passage 201 of the operating key 200, or by increasing the internal diameter of the interior passage 201 of the operating key 200 relative to the external diameter of the centerpin 125, or by a combination of both of these relative dimensional changes.

The locks 100, 1100 have tubular keyways 130, 1130 that are provided by the forwardly-opening annular spaces that surround the centerpins 125, 1125 (of the plugs 120, 1120) located within the confines of the passages 115, 1115 (of the housings 110, 1110). The centerpins 125, 1125 define the inner diameters of the tubular keyways 130, 1130—and, the front end regions of the passages 115, 1115 define the outer diameters of the tubular keyways 130, 1130—which enlarge in diameter as the keyways 130, 1130 extend rearwardly (rightly as viewed in FIGS. 5 and 4) to the rear of the reduced diameter front openings defined by the annular shoulders 114, 1114 of the locks 100, 1100, respectively.

Continuing to note the many subtle distinctions that preferably differentiate the enhanced tubular lock 100 from the PRIOR ART tubular lock 1100, it will be noted (by comparing the front openings of the tubular keyways 130, 1130 that are defined by the annular inwardly extending shoulders 114, 1114) that the annular shoulder 1114 of the housing 1110 of the PRIOR ART tubular lock 1100 extends farther radially inwardly than does the annular shoulder 114 of the enhanced lock 100. Stated in another way, the front opening of the keyway 130 of the enhanced tubular lock 100 is distinctly larger in diameter than is the front opening of the keyway 1130 of the PRIOR ART tubular lock 1100—so, once again, the enhanced tubular lock 100 receives the tubular portion 210 of the enhanced operating key more loosely than the tubular portion 1210 of the PRIOR ART tubular key 1200 which is received reasonably snugly by the front opening of the keyway 1130 of the prior art tubular lock 1100.

A further distinction of the enhanced lock and the PRIOR ART lock 1100 has to do with the fact that the tubular keyway 130 of the enhanced lock 100 (when measured in a direction parallel to the axis 105) is shorter than is the keyway 1130 of the PRIOR ART lock 1100 (when measured in a direction parallel to the axis 1105). The shorter keyway 130 (with its larger diameter front opening) provides less support than does the longer keyway 1130 of the PRIOR ART lock 1100 which fits reasonably snugly through the reduced diameter front opening of the longer keyway 1130. The shorter configuration of the keyway 130 as compared to the longer keyway 1130 can be seen by comparing the shorter dimension $C_1$ in FIG. 5 with the corresponding but longer dimension $C_2$ in FIG. 4.

One way of making the enhanced lock's keyway 130 shorter than the keyway 1130 of the PRIOR ART lock 1100 is to make the tapered bezel 160 of the housing 110 axially shorter than the tapered bezel 1160 of the housing 1110 of the PRIOR ART lock 1100—as can be seen by comparing the shorter dimension $B_1$ shown in FIG. 5 with the longer dimension $B_2$ shown in FIG. 4. This technique is preferably employed in forming the enhanced lock 100.

Extending along the peripheries of the keyways 130, 1130 in directions that parallel the axes 105, 1105 are the tumbler pins 140, 1140 of the locks 100, 1100. Nearly every tubular lock has axially extending tumbler pins that are quite like the depicted tumbler pins 140, 1140, and are used to operate whatever type of locking mechanisms (not shown) that are employed by the locks.

Figure 17:
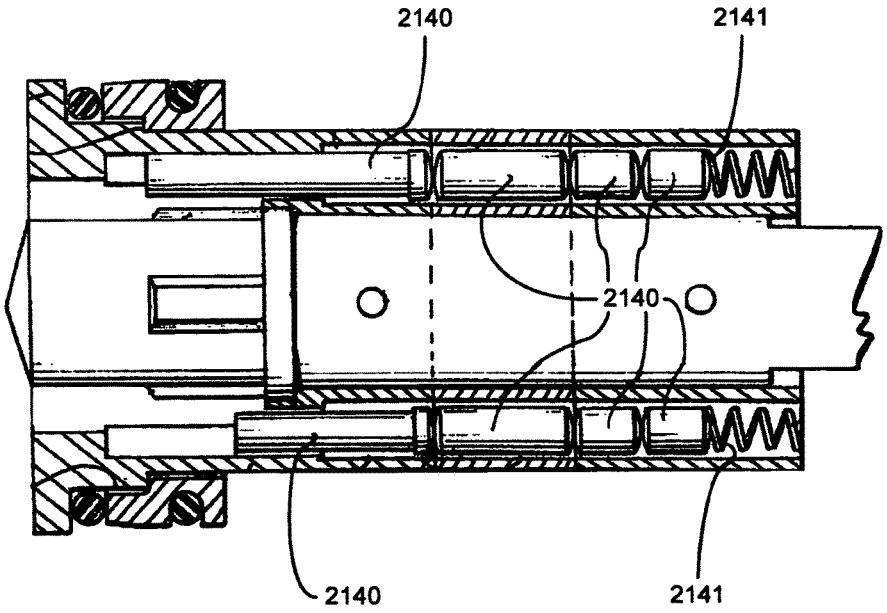
FIG. 17 is a cross-sectional view of a portion of another PRIOR ART tubular lock showing tumblers forwardly biased by springs.

The description needs to pause here to emphasize that the cross-sectional views provided by FIGS. 5 and 4 are "schematic" in character, and therefore do not provide true cross-sectional views of either of the locks 100 and 1100, respectively—in that, rear end regions of the tumbler pins 140, 1140 are not properly shown in FIGS. 5 and 4 (indeed, they are not shown at all in FIGS. 5 and 4), nor are various other components of such locking mechanisms as may be provided by the locks 100, 1100 typically at locations to the rear of (i.e., to the right of, as viewed in FIGS. 5 and 4) of the flat annular surfaces 116, 1116 of the plugs 120, 1120. As has been mentioned previously, those who are skilled in the art will readily understand that most tubular locks (such as the tubular lock disclosed in the previously referenced Walters et al patent) have springs that forwardly bias the tumbler pins 140, 1140. However, FIG. 17 provides a true cross-sectional view of a portion of another typical PRIOR ART tubular lock 2100 that does properly show such features as tumbler pins 2140 that are forwardly biased from the rear by corresponding springs 2141 that act on rear end regions of the rearmost ones of the tumbler pins 2140.

As can best be seen in FIGS. 3 and 2, the tubular locks 100, 1100 have four tumbler pins 140, 1140 that are arranged in equally spaced arrays that cause the tumbler pins 140, 1140 to extend along the outer diameters or the peripheries of the tubular keyways 130, 1130. Although the none of FIGS. 1-16 show any details of the biasing mechanisms that act on rear end regions of the tumbler pins 140, 1140, each of the tumbler pins 140, 1140 will be understood to be independently forwardly biased (i.e., biased leftwardly as viewed in FIGS. 5 and 4, respectively) by a biasing mechanism such as one of the springs 2141 depicted in FIG. 17 so that the flat front ends of the tumbler pins 140, 1140 are biased into abutting engagement with the thin, radially inwardly extending annular shoulders 114, 1114 of the housings 120, 1120.

Figure 14:
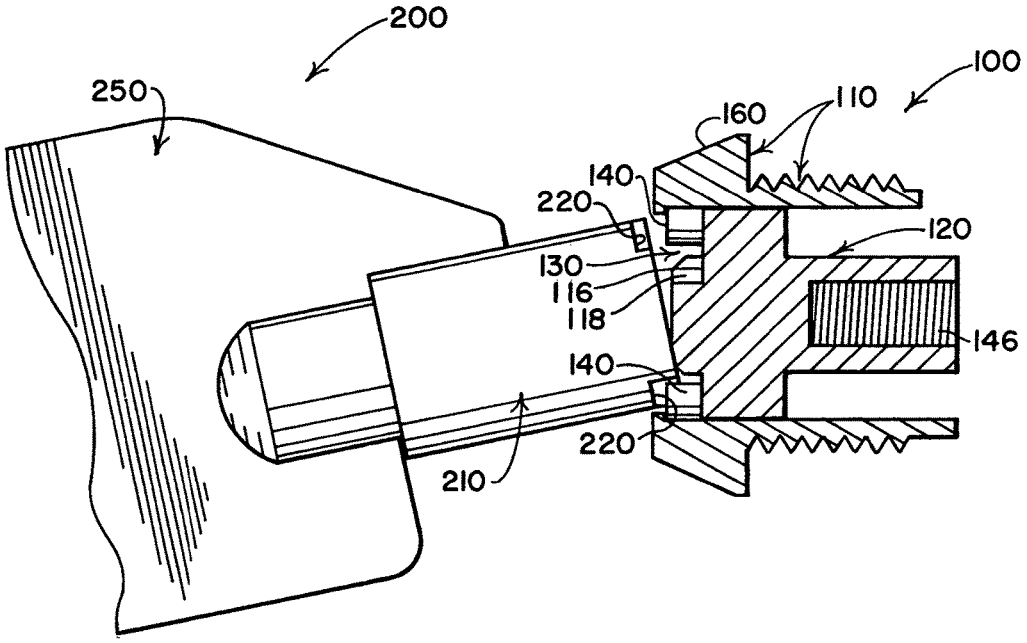
FIG. 14 is a schematic depiction of the selected lock and key portions shown in FIGS. 12 and 13, with the tubular operating key having its graspable bow tilted downwardly under the influence of gravity to illustrate that the keyway of the enhanced tubular lock provides no obstruction to such tilting, so the force of gravity acting on the operating key can cause the operating key to drop from the keyway of the lock.

As explained previously, the reduced diameter of the front opening of the keyway 1130 of the PRIOR ART lock 1100 receives the tubular portion 1210 of the PRIOR ART operating key 1200 reasonably snugly, whereas, in contradistinction, the larger front opening of the keyway 130 of the enhanced tubular lock 100 receives the smaller diameter tubular portion 210 of the enhanced operating key quite loosely—so loosely, in fact, that the tubular portion 210 has enough "play" to permit the enhanced key 200 to tilt downwardly as shown in FIG. 14, and to drop from the keyway 130 of the enhanced lock 100 under the influence of the force of gravity unless being manually held in the keyway 130.

Moreover, as has been mentioned previously, the tubular portions 210, 1210 of the operating keys 200, 1200 shown in FIGS. 9+11 and 8+10 extend for different distances into the tubular keyways 130, 1130 because the tubular keyway 130 of the enhanced lock 100 is shorter (when measured axially) than is the tubular keyway 1130 of the PRIOR ART lock 1100. This makes it even easier for the enhanced operating key 200 to tilt (downwardly under the influence of the force of gravity, as shown in FIG. 14) and fall from the keyway 130 unless the key 200 is being manually held in the keyway 130.

Because the operating keys 200, 1200 have recesses 220, 1220, respectively, that are of different depths (measured axially) that receive the tumbler pins 140, 1140 of the locks 100, 1100, respectively, when the operating keys 200, 1200 are inserted into the keyways 130, 1130 of the locks 100, 1100, the tumbler pins 140, 1140 are caused to move rearwardly different distances during insertion of the operating keys 200, 1200 into the keyways 130, 1130, respectively. Because the tumbler pins 140 are biased forwardly (leftwardly as viewed in FIG. 5), the enhanced operating key 200 is urged leftwardly by the biasing of the tumbler pins 140—which also helps the enhanced operating key 200 to withdraw from the keyway 130 and to drop from the keyway 130.

The "fully inserted positions" of the operating keys 200, 1200 are reached when the flat end surfaces 202, 1202 of the tubular portions 210, 1210 of the operating keys 200, 1200, respectively, engage the forwardly-facing flat annular shoulders 116, 1116 of the plugs 120, 1200 of the locks 100, 1100 that are located at the rear ends of the tubular keyways 130, 1130, respectively.

Shown in FIGS. 6 and 7 are the heads 145, 1145 of threaded fasteners that extend into threaded, rearwardly opening passages 146, 1146 (shown in FIGS. 4 and 5). When the threaded fasteners (not shown, except for the heads 145, 1145 that can be seen in FIGS. 6 and 7) are tightened into the passages 146, 1146, they fix the cams 150, 1150 to the plugs 120, 1120 to turn therewith about the axes 105, 1105 relative to associated ones of the housings 120, 1120 of the locks 100, 1100, respectively.

The configurations of the cams 150, 1150 that are shown in FIGS. 2-7 has nothing to do with the present invention. As those who are skilled in the art will readily understand, cams of a wide variety of configurations can be provided on the tubular locks 100, 1100—as may be called for by particular applications where the cam locks 100, 1100 are utilized.

A feature the cams 150, 1150 happen to share, has to do with limiting the range of permitted turning movement of the cams 150, 1150 to about a quarter turn as the locks 100, 1100 turn between their locked and unlocked positions. As can be seen in FIGS. 6 and 7, lower end regions of the radially extending cams 150 are provided with curved notches 151, 1151 that receive curved stop formations 152, 1152 that are defined by the housings 110, 1110. The curved stop formations 152, 1152 extend into the curved notches 151, 1151. The lengths of the curved notches 151, 1151 permit the cams 150, 1150 to turn thru quarter-turns of movement (about the axes 105, 1105) from the positions of the cams 150, 1150 that are shown in solid lines in FIGS. 6 and 7, to positions of the cams 150, 1150 that are partially shown by broken lines. When the plugs 120, 1120 turn in the passages 115, 1115 of the housings 110, 1110 to turn the cams 150, 1150 between the positions indicated by solid lines and by broken lines, the plugs 120, 1120 are turned between the locked and unlocked positions of the locks 100, 1100.

In order for the operating keys 200, 1200 to turn the plugs 120, 1120, driving connections must be established between the keys 200, 1200 and the associated plugs 120, 1120, respectively. Such a driving connection is established between the enhanced key 200 and the plug 120 of the enhanced lock 100 when a radially inwardly extending projection 240 (FIG. 11) of the key 200 is received in an axially extending centerpin groove 118 (FIGS. 1, 3 and 5) of the enhanced lock 100 during insertion of the enhanced key 200 into the keyway 130 of the enhanced lock 100. Such a driving connection is established between the PRIOR ART key 1200 and the plug 1120 of the PRIOR ART lock 1100 when a radially inwardly extending projection 1240 (FIG. 10) of the key 1200 is received in an axially extending centerpin groove 1118 (FIGS. 2 and 4) of the PRIOR ART lock 1100 during insertion of the PRIOR ART key 1200 into the keyway 1130 of the PRIOR ART lock 1100.

When the driving connections just mentioned are established, turning the keys 200, 1200 about the center axes 105, 1105 will cause the plugs 120, 1120 to turn in unison with the keys 200, 1200—but only at times when locking mechanisms (not shown) of the locks 100, 1100 permit the plugs 120, 1120 to turn relative to the housings 110, 1110 of the locks 100, 1100, respectively.

Among the many distinctions that may be incorporated into the enhanced lock 100 and/or into the enhanced key 200 is that the radially inwardly extending projection 240 of the enhanced key 200 is sized so that, when the projection 240 extends into the centerpin groove 118 of the enhanced lock 100, the projection 240 fits more loosely than does the radially inwardly extending projection 1240 when extending into the groove 1118 of the centerpin 1125 of the PRIOR ART lock 1100. This looseness of fit can be created by diminishing the circumferentially extending width of the radially inwardly extending projection 240, or by increasing the circumferentially extending width of the centerpin groove 118, or by a combination of these dimensional changes, as compared to how the radially inwardly extending projection 1240 of the PRIOR ART key 1200 fits when inserted into the centerpin groove 1118 of the PRIOR ART lock 1100.

Present-day tubular locks (such as the typical PRIOR ART tubular lock 1100 as shown in FIGS. 2 and 4) have at least one, and often have two, notches or cuts (such as are designated by arrows $A_2$ in FIG. 2) that slice through the radially inwardly extending annular shoulder 1114 that defines the relatively small diameter front portion of the housing passage 1115.

As can be seen in FIG. 2, the notches or cuts designated by the arrows $A_2$ include one notch or cut 1133 at a 12 o'clock position along the inwardly facing circumference of the annular shoulder 1114, and another notch or cut 1134 at a 3 o'clock position along the inwardly facing circumference of the annular shoulder 1114. Present-day tubular operating keys (such as the typical PRIOR ART tubular operating key 1200 shown in FIGS. 8 and 10) have a radially outwardly extending projection (such as is indicated by the numeral 1230 in FIGS. 8 and 10) that can move thru one of the notches or cuts 1133 or 1134 when the PRIOR ART key 1200 is turned to align the projection 1230 of the key 1200 with one or the other of the notches or cuts 1133 and 1134.

Extending between the notches or cuts 1133, 1134 of the PRIOR ART lock 1100 shown in FIG. 2 is a curved quarter of the annular, radially inwardly extending shoulder 1114 that is labeled by an arrow "Z." When the tubular portion 1210 of the PRIOR ART operating key 1200 is inserted into the keyway 1130 of the PRIOR ART lock 1100, the radially outwardly extending projection 1230 (referred to just above) must pass through one or the other of the notches or cuts 1133, 1134—and, having passed through one of the notches 1133, 1134, the PRIOR ART operating key 1200 can be turned to move the radially outwardly extending projection 1230 so the projection comes to reside behind the curved shoulder Z—which positively causes the inserted PRIOR ART operating key 1200 to be retained in the keyway 1130 of the PRIOR ART lock 1100.

As such, the notches or cuts 1133, 1134 and the connecting shoulder Z of the PRIOR ART lock 1100, and the radially outwardly extending projection 1230 of the PRIOR ART operating key 1200 constitute interfitting formations of the PRIOR ART lock 1100 and the PRIOR ART operating key 1200 that not only absolutely provide support to the operating key 1200 (any time that the operating key 1200 is turned the slightest amount after being inserted through one of the notches or cuts 1133, 1134), but also defines two very specific orientations (namely 3 o'clock or 12 o'clock orientation as viewed in FIG. 2) to which the PRIOR ART operating key 1200 must be turned anytime it is desired to withdraw the PRIOR ART operating key 1200 from the keyway 1130 of the PRIOR ART lock 1100.

Referring to FIG. 6, the fact that the curved stop formation 1152 of the housing 1110 of the PRIOR ART lock 1100 extends rearwardly into the curved recess 1151 of the plug 1120 (and thereby limits the turning of the plug 1120 to a particular quarter turn quadrant of angular movement relative to the housing 1110) means that when the PRIOR ART operating key 1200 is inserted into the keyway 1130 of the PRIOR ART lock 1100, the PRIOR ART operating key 1200 can only turn through a particular quarter turn of movement as the key 1200 drivingly engages and turns the plug 1120 of the PRIOR ART lock 1100. The permitted quarter turn of angular movement of the operating key 1200 is the quarter turn that causes the radially outwardly extending projection 1230 (FIGS. 8+10) to reside behind the curved quarter-portion of the radially inwardly extending annular shoulder 1114 of the PRIOR ART lock 1100 that is indicated in FIG. 2 by the arrow Z.

In simple English, what the explanation presented just above means is that, when the typical PRIOR ART operating key 1200 is inserted into the keyway 1130 of the typical PRIOR ART lock 1100, the operating key 1200 can only turn a quarter turn—and, the radially outwardly extending projection 1130 can only reside behind a particular quarter segment of the radially inwardly extending annular shoulder 1114—namely, the segment indicated by the arrow Z. Moreover, the PRIOR ART operating key 1200 can only be fully inserted into the keyway 1130 of the PRIOR ART lock 1100 when the radially outwardly extending projection 1230 is turned precisely to either a 12 o'clock orientation (so the projection 1230 can pass through the notch, cut or slot 1133) or a 3 o'clock orientation (so the projection 1230 can pass through the notch, cut or slot 1134). Likewise, the PRIOR ART operating key 1200 can only be withdrawn from the keyway 1130 when the key 1200 is turned so that the radially outwardly extending projection 1230 is turned to either a 12 o'clock orientation or to a 3 o'clock orientation so the projection 1230 can pass back out through one or the other of the notches, cuts or slots 1133, 1134, respectively.

In complete contradistinction, the enhanced operating key 200 can be inserted into, and withdrawn from, the keyway 130 of the enhanced lock at absolutely any orientation to which the enhanced key 200 may be turned—and, can be withdrawn from the keyway 130 at absolutely any orientation to which the enhanced key 200 may be turned. Moving the enhanced key 200 to a "fully inserted position" can only take place when the inwardly extending projection 240 (FIG. 11) of the enhanced key 200 is aligned with and is received in the centerpin groove 118—but, insertion of the enhanced key 200 at least part way into the keyway 130 can take place regardless of how the enhance key 200 is turned relative to the enhanced lock 100; and, the enhanced operating key 200 is always free to drop out of the keyway 130 regardless of how the enhanced key 200 may be turned or angularly oriented about the axis 105.

In view of what is explained above, the reader will understand that, among the somewhat subtle distinctions that differentiate the enhanced tubular lock 100 and the enhanced operating key 200 from the PRIOR ART lock 1100 and the PRIOR ART operating key 1200, is the fact that the enhanced tubular lock does not have any notches or cuts such as are indicated by the arrows $A_2$ (or by the numerals 1133, 1134) in FIG. 2; nor does the enhanced operating key 200 have any radially outwardly extending projection such as is indicated by the numeral 1230 in FIGS. 8 and 10.

Figure 15:
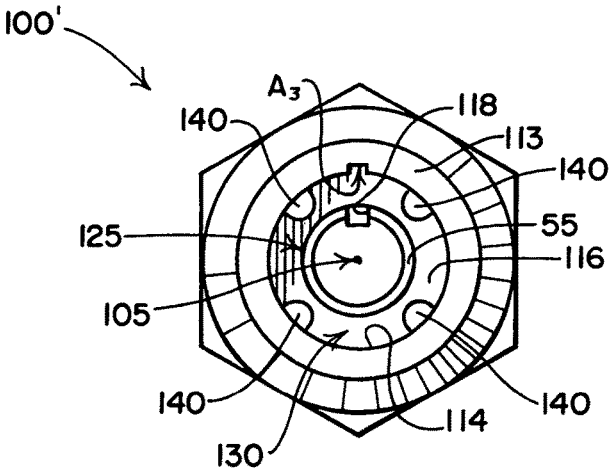

One exception (to the preferred complete absence of the notches, slots or cuts being formed through the radially inwardly extending annular shoulder 114 of the enhanced lock 100) is contemplated. Referring to FIG. 15, in one alternate embodiment 100' of the enhanced lock 100, quite a tiny, barely visible, notch designated by an arrow $A_3$ may be provided—simply as an orientation indicator for use by installers of the enhanced lock embodiment 100'—so that, when the lock embodiment 100' is being installed on a food freezer appliance, the lock embodiment 100' is not accidentally installed upside down. In FIG. 15, the notch indicated by the arrow $A_3$ is exaggerated in size—so the reader will not overlook its presence. If such a notch (as is indicated in FIG. 15 by the arrow $A_3$ is provided, it preferably is only about 0.004 inch deep—which is just enough of a notch to be visible.

Optimizing the Influence of the Force of Gravity

As explained previously, the present invention may utilize one or more of three basic approaches in order to make optimal use of the influence of the force of gravity to ensure that enhanced tubular operating keys are not retained (either inadvertently or deliberately) in the keyways of enhanced tubular locks, namely:

1) Loosening the "Fit" of operating keys within the keyways of the enhanced tubular locks used on food freezer appliances and the like—certainly to minimize, and preferably to eliminate substantially all vertical support that is provided to an enhanced operating key that is inserted into the keyway of an enhanced tubular lock—to thereby encourage and ensure that enhanced operating keys fall from the keyways of enhanced tubular locks under the influence of the force of gravity unless the keys are manually held in the keyways;

2) Eliminating Interactive Formations of the keys and keyways of food freezer locks that have traditionally been provided to ensure that PRIOR ART operating keys are securely retained in PRIOR ART tubular locks after being inserted and turned slightly from the one or two quite specific orientations required for key insertion and removal—to make certain that a keyway-inserted enhanced operating key is always ready to fall from the keyway of an enhanced lock under the influence of the force of gravity regardless of how an enhanced operating key may be turned in the keyway of an enhanced lock; and, 3) Increasing Length, Weight and Effective Lever-Arm of operating keys—to increase the effectiveness of the influence of the force of gravity in causing enhanced operating keys to fall from the keyways of enhanced locks.

Regarding the first of the three approaches that are listed above, the lengthy description presented above includes an explanation of many of the ways in which the enhanced lock 100 and the enhanced operating key 200 can be individually or cooperatively dimensionally modified to ensure that the enhanced operating key 200 fits quite loosely when inserted into the tubular keyway 130 of the enhanced lock 100.

Regarding the second of the approaches listed above, the lengthy description presented above also explains that the enhanced operating key 200 is provided with no radially outwardly extending projection such as the projection 1230 on the PRIOR ART operating key 1200—and that the enhanced lock 100 is provided with no cuts or slots 1133, 1134 such as are provided in the PRIOR ART lock 1100—so no interengaging formations are present that restrict key insertion and withdrawal, or that provide support to a keyway-inserted enhanced operating key 200.

Regarding the third of the above-listed approaches, reference is now made to FIGS. 8 and 9, and to the following explanation of how the enhanced operating key 200 is preferably fabricated to distinguish the enhanced operating key 200 of FIGS. 9+11 from the PRIOR ART operating key 1200 of FIGS. 8+10.

As can easily be seen by comparing the key depictions presented in FIGS. 8 and 9, the graspable bow 250 of the enhanced operating key 200 is considerably longer than is the graspable bow 1250 of the PRIOR ART operating key 1200—which means that the center of gravity 299 (FIG. 9) of the enhanced operating key 200 is spaced significantly farther from the front face 113 of an enhanced lock 100 (when fully inserted into the keyway 130 of the enhanced lock 100) than is the center of gravity 1299 (FIG. 8) of the PRIOR ART operating key 1200 (when fully inserted into the keyway 1130 of the PRIOR ART lock 1100.

Lines labeled $P_1$ and $P_2$ can be seen in FIGS. 9 and 8, respectively, that are intended to represent where the front faces 113, 1113 of the locks 100, 1100, respectively will reside when the operating keys 200, 1200 are fully inserted into the keyways 130, 1130 of the locks 100, 1100, respectively. Because the keyway 130 of the enhanced lock 100 is preferably made shorter than is the keyway 1130 of the PRIOR ART lock 1100 (as has been explained above), the plane $P_1$ is located closer to the flat end region 202 of the enhanced operating key 200 than the plane $P_2$ is located relative to the flat end region 1202 of the PRIOR ART operating key 1200.

Referring to FIGS. 9 and 8, although the two operating keys 200, 1200 have similarly sized and configured tubular components 210, 1210, the graspable bow 250 of the enhanced operating key 200 is much longer than is the graspable bow 1250 of the PRIOR ART operating key 1200. Assuming that the graspable bows 250, 1250 are of equal width (i.e., of equal vertical dimension as shown in FIGS. 8 and 9) and are of equal thickness, the fact that the graspable bow 250 of the enhanced operating key 200 is longer than the graspable bow 1250 of the PRIOR ART operating key 1200 means that more metal is used in fabricating the enhanced operating key 200 than is used to fabricate the PRIOR ART operating key 1200—and, that the enhanced operating key 200 is therefore almost undoubtedly of heavier weight than is the PRIOR ART operating key.

The longer length of the graspable bow 250 of the enhanced operating key 200 (in comparison with the graspable bow of the PRIOR ART operating key 1200) has a center of gravity 299 (FIG. 8) that is displaced farther from the plane $P_1$ than the center of gravity 1299 of the PRIOR ART operating key 1299 from the plane $P_2$—as can be seen by comparing the longer length $L_1$ shown in FIG. 9 to the shorter length $L_2$ shown in FIG. 8.

Using FIGS. 9 and 8 to draw so-called "force diagrams" (as engineers are taught to do when attending applied mechanics courses at engineering colleges), the weight of the enhanced key 200 (represented by the arrow $W_1$ in FIG. 9) can be thought of as acting downwardly through the center of gravity 299 of the enhanced key 200—and, any vertical support provided to the enhanced key 200 by the enhanced lock 100 can be thought of as being represented by an arrow $K_1$ acting upwardly at about the location of the plane $P_1$, it will be seen that the forces $W_1$ and $K_1$ apply torque to the enhanced operating key 200 that acts through the relatively lengthy lever-arm $L_1$—which is a considerably greater torque than is applied by the lighter weight $W_2$ acting through the center of gravity 1299 (shown in FIG. 8) and the vertical supporting force $K_2$ that utilize a much shorter lever-arm $L_2$.

In simple English, the heavier weight of the enhanced operating key 200 is much more likely to be successful in causing the longer, heavier, looser fitting, minimally supported enhanced operating key 200 to withdraw and fall downwardly and out of the keyway 130 (as depicted in FIG. 15) than the lighter weight of the shorter, snugly fitting PRIOR ART operating key 1200 is to withdraw and fall from the keyway 1130 of the PRIOR ART lock 1100. In fact, PRIOR ART operating keys such as the key depicted in FIG. 8 are well known to universally be retained in the keyways of such PRIOR ART tubular locks as the lock depicted in FIGS. 2+4+6.

More specifically, whereas the PRIOR ART tubular operating key 1200 has a graspable bow 1250 that has a size of between about that of a present-day nickel coin to about the size of a present-day quarter coin, and a thickness of between about that of a present-day penny coin to about that of a present-day nickel coin. The enhanced operating key 200 has a graspable bow 1250 that has a size of between about that of about two present-day quarter coins laid side-by-side, to about the size of three present-day quarter coins laid side-by-side—and a thickness of at least about that of a present-day quarter coin. The width (vertical height as depicted in FIGS. 8 and 9) of the enhanced operating key 200 is also preferably about 10 percent greater than that of the typical present-day PRIOR ART operating key 1200 depicted in FIG. 8. All in all, the enhanced operating key 200 is heavier and larger than the PRIOR ART operating key 1200—so, the third approach mentioned above is also utilized by the enhanced operating key 200 as compared to the PRIOR ART operating key 1200.

Rendering Difficult Use of the Enhanced Operating Key

Although preventing operating keys from being inadvertently or deliberately retained in the keyways of food freezer locks provides a major step toward enhancing the safety of food freezer appliances, the present invention preferably takes yet another step toward improving the safety of food freezer appliances.

Whereas locks and keys have almost always been designed with an eye toward improving the ease with which the operating keys can be used, the present invention preferably takes quite an opposite approach. The present invention flies in the face of this traditional objective—because, if children find the correctly configured keys that can operate food freezer locks, they often are inclined to attempt to use or to play with the newly discovered keys—and, this can result in child entrapment.

The present invention preferably uses the approach of requiring that, for a correctly configured operating key to be successfully used to operate a tubular lock, the operating key must be properly oriented during insertion into the keyway of a tubular lock.

To grasp why this approach is effective, the reader needs first to remember that the enhanced lock 100 is not at all restrictive regarding how a properly configured operating key 200 can be inserted into the keyway 130 of the enhanced lock 100. Whereas the PRIOR ART tubular lock 1100 is quite restrictive regarding how its operating key 1200 must be inserted (i.e., the operating key 1200 must be turned so the radially outwardly extending projection 1230 of the operating key 1200 must be turned to either a 12 o'clock or to a 3 o'clock orientation in order to be fully inserted into the keyway 1130), the enhanced operating key 200 of the present invention can be inserted at least part of the way into the keyway 130 at substantially any angularly turned orientation—and, a child will likely be frustrated because no operation of the enhanced lock 100 can be achieved by such a randomly oriented insertion of the operating key 200 into the keyway 130 of the lock 100.

To achieve operation of the enhanced lock 100, the operating key 200 must be inserted with the recesses 220 in the tubular portion 210 of the operating key 200 aligned with, so they receive, engage and rearwardly depress the correct tumbler pins 140. Trying to insert the operating key 200 into the keyway 130 with the recesses 220 aligned with the wrong tumbler pins 140 will not permit the required amount of rearward movement of the tumbler pins 140—and therefore will not cause whatever sort of locking mechanism is employed by the lock 100 to permit operation of the lock 100.

The fact that the centerpin 125 is provided with a chamfer 55 AND is shorter than is the keyway 130 of the enhanced lock 100 will permit a correctly configured operating key 200 to be inserted some of the way into the keyway 130—but, if the operating key 200 is incorrectly turned or oriented when inserted into the keyway 130 of the operating key 200, the wrong tumbler pins 140 will begin being inserted into the recesses 220 of the tubular portion of the operating key 200 during key insertion, and this will obstruct and prevent the operating key 200 from being turned to align the radially inwardly extending projection 240 with the centerpin groove 118—which is what is required for full insertion of the correctly configured operating key 200 into the keyway 130 of the enhanced lock.

In short, if the operating key 200 is not properly oriented at the beginning of insertion of the operating key 200 into the keyway 130 (so the correct tumbler pins 140 are received in the recesses 220 of different depth that are provided in the tubular component 210 of the operating key 200, the operating key 200 cannot be used to operate the enhanced lock 100—which will frustrate those who do not know how to properly insert the enhanced operating key 200 into the keyway 130 for the purpose of operating the lock 100.

This principle of rendering difficult the use of a correctly configured enhanced operating key 200 to operate an enhanced tubular lock is dependent, at least in part, on providing the centerpin 125 with a shorter length than the keyway 130 and on providing the centerpin 125 with quite a distinct chamfer 55—namely a combination of features that will' let the correctly configured enhanced operating key 200 to be at least partially inserted into the keyway 130 regardless of the orientation of the operating key 200 relative to the enhanced lock 100. At least a partial insertion of the operating key 200 is needed to cause the tumbler pins 140 to begin being inserted into the recesses 220 of the operating key 200—and, full and complete insertion of the operating key 200 is only possible if the operating key 200 was correctly oriented when its insertion into the keyway 130 began.

Partial insertion of an incorrectly oriented but correctly configured operating key 200 will cause the wrong tumbler pins 140 to be received in the recesses 220 of the operating key 200, and this will lock the operating key 200, preventing it from operating the lock 100, and from being turned to a correct orientation where full insertion of the operating key 200 into the keyway 130 can be completed.

Those who are skilled in the art will undoubtedly see other ways in which partial insertion of an incorrectly oriented operating key 200 can be accomplished (other than to use a shortened centerpin 125 that has a significant chamfer 55 (that combine to let the operating key 200 to accomplish partial insertion into the keyway 130), but use of this combination of features is presently preferred.

Figure 16:
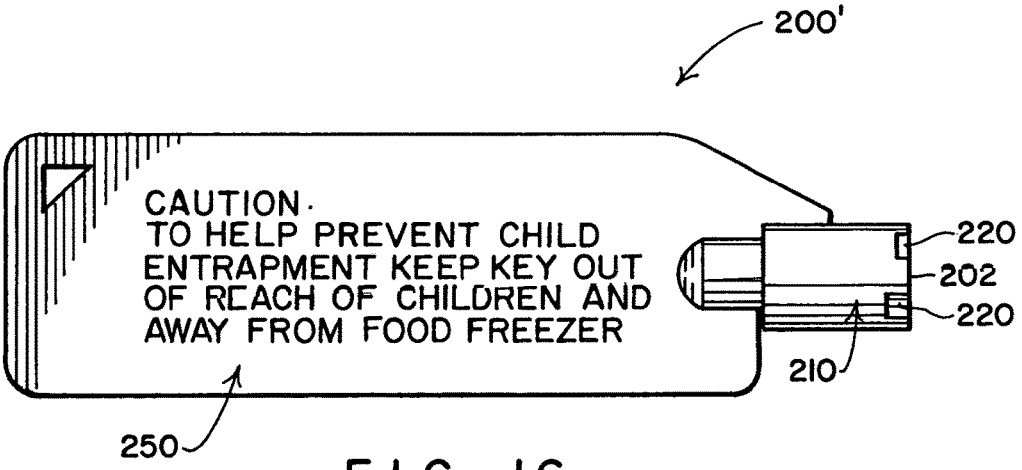
FIG. 16 is a side elevational view of a preferred embodiment of the enhanced tubular operating key similar to FIG. 9 but showing a typical warning message imprinted on the graspable bow of the key.

To accomplish a correct insertion of the enhanced operating key 200 that will permit the operating key 200 to be used, with success, to operate the enhanced lock 100, one first needs to observe that, inside the keyway 130 of the tubular lock 100 is a centerpin groove 118 that easily can be viewed when looking at the front of the enhanced lock 100—as can be seen in FIGS. 1+3+15. The graspable bow 250 of one embodiment 200' of an enhanced operating key 200 is depicted in FIG. 16. The graspable bow 250 of the operating key is imprinted both with a text warning 275 (that is fairly common)—as was explained earlier in this document. Also provided on the graspable bow 250 is a small arrow 276.

On an opposite side of the graspable bow 250 (not shown) can be substantially the same text warning 276, but presented in an alternate language such as French or Spanish—and a substantially identical small arrow 276 pointing in substantially the same direction as the arrow 276 shown in FIG. 16.

In an instruction manual provided with the food freezer, and/or on a small bag or other packet (not shown) containing a set of two of the enhanced operating keys 200, an explanation can be provided that tells the new owner of the food freezer appliance that the arrows 276 on the bow of the key 200 must point toward the centerpin groove 118 when the operating key 200 is inserted into the enhanced lock 100 for the operating key 200 to successfully operate the lock 100.

Alternatively, it can be explained to the new owner that, when the plug 120 of the lock 100 is turned so the centerpin groove 118 opens upwardly, the operating key 200 must be inserted into the lock with the text on the bow being positioned to be read from the right side of the lock (if English text is preferred), or the bow of the key 200 must be positioned to be read from the left side of the key 200 if the alternate language text is preferred)—and that, when the centerpin groove 118 is turned to a different position, the graspable bow 250 of the key 200 must point toward the centerpin groove 118 during insertion of the operating key 200 into the keyway 130 of the lock 100.

Although the invention has been described in its preferred form with a certain degree of particularity, it is understood that the present disclosure of the preferred form has been made only by way of example, and that numerous changes in the details of construction and the combination and arrangement of parts and the manner of operation may be resorted to without departing from the spirit and scope of the invention. It is intended that the following claims cover such features of the present invention as are entitled to patent protection.

What is claimed is:

1. A tubular lock and tubular operating key, with the key having a tubular portion that is movable along a horizontal axis extending centrally through a tubular keyway of the lock to a fully inserted position where the lock can be operated by turning the tubular portion about the horizontal axis, with the key and the keyway being cooperatively configured to ensure that the tubular portion of the key fits sufficiently loosely in the keyway even when at the fully inserted position, and with the lock providing no obstruction to removal of the key from the keyway regardless of how the key is turned while in the keyway, that the key will drop from the keyway under the influence of the force of gravity unless being held in the keyway.

2. The lock and key of claim 1 that are configured to permit the key to be turned at least a quarter turn between locked and unlocked orientations when the tubular portion has been inserted to the fully inserted position, and with the lock and key having no interfitting formations that obstruct withdrawal of the tubular portion of the key from the keyway regardless of how the tubular portion is turned about the horizontal axis.

3. The lock and key of claim 1 with the key having a relatively flat graspable bow that is not insertable into the keyway of lock and is of sufficient size to cause a center of gravity of the fully inserted key to be positioned at a sufficient distance from a front face of the lock to cause the graspable bow to tilt downwardly under the influence of the force of gravity unless the key is manually supported in the keyway.

4. The lock and key of claim 1 with the key having a graspable bow portion not insertable into the keyway of the lock, with a length of the graspable bow, as measured along the horizontal axis, being at least twice the 24.26 millimeter diameter of a current-day quarter coin.

5. The lock and key of claim 1 with the lock having a housing with a passage formed therethrough, and having a plug journaled in the passage that defines a centerpin that extends forwardly toward an open front end region of the housing, with the keyway being defined between the centerpin and the front end region of the passage, with the centerpin having a substantially uniform diameter extending for a length less than the length of the outer diameter of the keyway that is defined by the housing of the lock, and with the centerpin having a chamfer at its front end that extends in the manner of a truncated cone from the substantially uniform diameter of the centerpin to provide a circular flat front end of the centerpin that has a diameter of that is substantially 75 percent of the uniform diameter of the centerpin.

6. The lock and key of claim 1 with the key being capable of operating the lock only if the tubular portion of the key has been turned to a particular orientation before being moved along the central axis during insertion into the keyway to the fully inserted position.

7. The lock and key of claim 6 with the lock having a housing that defines the outer diameter of the tubular keyway, and neither the key nor the housing explains the correct particular orientation to which the key must be turned before being moved along the central axis during insertion of the tubular portion into the keyway to the fully inserted position.

8. The lock and key of claim 6 with the key having a graspable bow portion with a text message printed on a selected side thereof, and with the correct particular orientation being reached when the graspable bow is held to extend vertically so the text message is right-side-up for being easily read.

9. The lock and key of claim 1, with the lock having a housing, that defines no slot or cut near the tubular keyway through which any portion of the key must pass to be inserted into or withdrawn from the keyway, but with the housing of the lock having a small orientation marking that is visible from an exterior of the housing to assist installers.

10. The lock and key of claim 1 with the key having a substantially flat graspable bow portion that is not insertable into the keyway and has a length ranging from the twice the 24.26 millimeter diameter of a current-day quarter coin to three times the 24.26 millimeter diameter of a current-day quarter coin.

11. The lock and key of claim 10 with the graspable bow portion being substantially rectangular and having a width ranging from the 21.21 millimeter diameter of a current nickel coin to the 24.26 millimeter diameter of a current quarter coin, and having a thickness ranging from the 1.95 millimeter thickness of a current nickel coin to the 1.75 millimeter thickness of a current quarter coin.

12. The lock and key of claim 1 with the key having a graspable bow portion with a text message printed on a selected side thereof, and the correct particular orientation is reached when the graspable bow is held vertically so the text message is right-side-up for being easily read.

13. A food freezer lock and an operating key configured to unlock the lock when the operating key is turned after being inserted into a forwardly opening, horizontally extending keyway of the lock to a position where forwardly biased tumblers of the lock are engaged and rearwardly depressed by the operating key, with the keyway and the operating key being configured to cause the operating key, when left inadvertently extending into the keyway, to drop from the keyway under the influence of the force of gravity.

14. A method of enhancing the safety of a lockable food freezer appliance by equipping the appliance with a tubular lock that is operable by turning a tubular portion of an operating key about a horizontally extending axis after the tubular portion has been moved along the axis to a fully inserted position within a tubular keyway of the lock, with the key and the keyway being cooperatively configured so the key fits so loosely in the keyway and is so minimally vertically supported while at any location along the keyway that the key drops from the keyway under the influence of the force of gravity unless the key is manually held in the keyway.

15. The method of claim 14 additionally including the step of providing the tubular operating key with a graspable bow of such size and weight as will cause the center of gravity of the key to be located at a distance spaced along the axis away from a front face of the lock that is sufficient to cause the bow of the key to tilt downwardly regardless of the extent to which the key is inserted into the keyway of the lock unless the key is being manually held in the keyway of the lock.

16. The method of claim 14 additionally including the step of providing the tubular operating key with a graspable bow portion that cannot be inserted into the keyway and has a length measured along the axis that is at least twice the 24.26 millimeter diameter of a current-day quarter coin.

17. The method of claim 14 additionally including the step of configuring the operating key so that it must be turned to a particular orientation when inserted into the keyway in order to successfully operate the lock.

18. The method of claim 17 additionally including the step of providing no explanation on either the operating key or on the tubular lock of the particular orientation to which the operating key must be turned when inserted.

19. The method of claim 18 additionally including the step of providing axially extending tumbler pins extending along peripheral portions of the keyway of the lock that must be engaged by correctly configured recesses of the key in order for the key to be inserted into the keyway to the fully inserted position.

20. The method of claim 19 additionally including the step of cooperatively configuring the keyway and the tubular portion of the key to permit partial insertion of the tubular portion into the keyway even when the key is not turned to the particular orientation, with the tumbler pins being capable of entering the recesses of the key to prevent the partially inserted key from being turned to the particular orientation.

21. A lock and key comprising a lock having a keyway that extends substantially concentrically about a substantially horizontally extending axis when installed, and a key having a lock operating portion that can be moved along the axis to be inserted into the keyway to a fully inserted position where the configuration of the operating portion of the key permits the key to operate the lock, with the key and the keyway also being cooperatively configured so the key will drop from the keyway under the influence of the force of gravity when inserted to the fully inserted position unless held in the keyway.

22. A method of preventing an operating key of a tubular lock suitable for use on food freezer appliances from being inadvertently left in the horizontally extending keyway of the tubular lock comprising the step of co-operatively configuring the keyway and a keyway-insertable portion of the operating key to drop from the keyway under the influence of the force of gravity when inserted to an operating position in the keyway unless the key is held in the keyway.

* * * * *